US006510981B1

(12) United States Patent
Deering et al.

(10) Patent No.: US 6,510,981 B1
(45) Date of Patent: Jan. 28, 2003

(54) CANISTER WITH PAPER AND PLASTIC LAYERS AND A PLASTIC LID FOR CONTAINING A PARTICULATE-TYPE PRODUCT, SUCH AS A READY-TO-EAT CEREAL

(75) Inventors: Curtis J. Deering, Maple Grove, MN (US); Gordon H. Meier, Brooklyn Park, MN (US); Sarah J. Moberg, Elk Grove, CA (US); Patrick J. Sumpmann, Maple Grove, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/584,008

(22) Filed: May 30, 2000

Related U.S. Application Data

(63) Continuation-in-part of application No. 09/328,917, filed on Jun. 9, 1999, now abandoned.

(51) Int. Cl.[7] ..... B65D 43/16

(52) U.S. Cl. ..... 229/125.05; 220/258.1; 220/258.3; 220/259.1; 229/120; 229/123.3; 229/125.08; 229/125.09; 426/115

(58) Field of Search ..... 229/123.1, 123.2, 229/123.3, 125.05, 125.08, 125.09, 125.14, 120; 220/258.1, 258.3, 259.1; 426/106, 115, 122, 124, 127

(56) References Cited

U.S. PATENT DOCUMENTS

| | | | | |
|---|---|---|---|---|
| 2,120,906 A | | 6/1938 | Moore | |
| 2,889,976 A | | 6/1959 | Van Cantfort | |
| 2,906,439 A | | 9/1959 | Santuci, Sr. | |
| 2,971,686 A | | 2/1961 | Mühlhoff | |
| 3,298,590 A | * | 1/1967 | Gray | 229/125.08 |
| 3,973,719 A | * | 8/1976 | Johnson et al. | 229/125.08 |
| 4,267,937 A | | 5/1981 | Piltz et al. | |
| 4,421,236 A | * | 12/1983 | Lowe | 229/131 |
| 4,430,816 A | | 2/1984 | Seton et al. | |
| 4,459,793 A | | 7/1984 | Zenger | |
| 4,466,553 A | | 8/1984 | Zenger | |
| 4,473,168 A | | 9/1984 | Cox | |
| 4,491,252 A | | 1/1985 | Schmidt et al. | |

(List continued on next page.)

FOREIGN PATENT DOCUMENTS

| | | |
|---|---|---|
| WO | WO 99/30974 | 6/1999 |

OTHER PUBLICATIONS

Three–Dimensional Pioneer® Baking Mix packaging as shown in five photographs depicting different views, Copyright 1996 Pioneer Flour Mills.

*Primary Examiner*—Gary E. Elkins
(74) *Attorney, Agent, or Firm*—John A. O'Toole; Douglas J. Taylor; Timothy A. Czaja

(57) ABSTRACT

A canister for containing a particulate-type product such as a ready-to-eat cereal. The canister includes a side wall, a bottom closure and a plastic lid. The side wall defines at least a portion of a tubular body having an upper opening, a lower opening and an internal storage region for containing the particulate-type product. In this regard, the side wall includes a first, paper-based layer and a second, plastic-based layer. The first, paper-based layer has an inner surface and an outer surface. The second, plastic-based layer is bonded to the inner surface of the first, paper-based layer. The bottom closure is connected to the side wall so as to encompass the bottom opening. The plastic lid is openably secure to the tubular body at the upper opening. In this regard, the plastic lid provides selective access to the internal storage region. With this configuration, the plastic lid facilitates rapid fabrication of the canister, as well as providing for increased canister durability.

29 Claims, 6 Drawing Sheets

U.S. PATENT DOCUMENTS 4,515,266 A * 5/1985 Myers ..... 229/120
4,538,758 A * 9/1985 Griffith ..... 229/4.5
4,579,246 A 4/1986 Swearingen et al.
4,583,679 A * 4/1986 Johnson ..... 229/125.05
4,673,126 A * 6/1987 Hambleton ..... 229/125.08
4,736,870 A * 4/1988 Christensson ..... 229/125.09
4,768,703 A * 9/1988 Sosler et al. ..... 229/125.05
4,775,098 A 10/1988 Peer, Jr. et al.
4,817,829 A 4/1989 Fuchs et al.
4,886,164 A 12/1989 Stein et al.
4,940,191 A * 7/1990 Dolby ..... 229/125.14
5,083,701 A * 1/1992 Passamoni ..... 229/125.08
5,211,305 A 5/1993 Horton
5,566,529 A 10/1996 Sireix
5,688,544 A 11/1997 Bolton et al.
5,727,819 A 3/1998 Grosskopf et al.
6,261,615 B1 * 7/2001 Sumpmann et al. ..... 426/106
6,267,243 B1 * 7/2001 Sumpmann et al. ..... 206/459.5
6,338,864 B1 * 1/2002 Deering et al. ..... 426/106

* cited by examiner

CANISTER WITH PAPER AND PLASTIC LAYERS AND A PLASTIC LID FOR CONTAINING A PARTICULATE-TYPE PRODUCT, SUCH AS A READY-TO-EAT CEREAL

CROSS-REFERENCE TO RELATED APPLICATIONS

This application is a continuation-in-part of U.S. patent application Ser. No. 09/328,917, entitled "Canister For A Particulate-Type Product" filed on Jun. 9, 1999, now abandoned.

BACKGROUND OF THE INVENTION

The present invention relates generally to a canister for containing a particulate-type product. More particularly, the present invention relates to a paper and plastic formed canister including a plastic lid that contains a particulate-type product, such as a ready-to-eat cereal food product therein.

An extremely popular form of packaging for dry, particulate-type products sold to consumers is a paper carton. The paper carton normally is rectangular-shaped, constructed of one or more layers of paper (such as label stock or paperboard having printing on an outer surface), and may or may not include an inner plastic liner. A wide variety of different products are packaged in this form, ranging from consumable items such as ready-to-eat (RTE) cereals and baking goods to non-consumable items such as laundry detergents and de-icing salt pellets.

Paper cartons present a number of advantages for manufacturers, retailers, and consumers. For example, paper cartons are relatively inexpensive to manufacture and provide a number of flat surfaces onto which product or promotional information can be displayed. Due to the rectangular, parallel-piped shape, the cartons are relatively rigid and readily stackable. Thus, a manufacturer can ship a large number of stacked cartons without experiencing product damage. Further, a retailer can maximize shelf space while fully displaying the product. Consumers likewise find the stackability characteristic desirable for home storage. Finally, paper cartons can be sized in accordance with consumer product volume preferences.

Certain types of products are amenable to storage within a paper carton alone. Generally speaking, however, a paper carton cannot, in and of itself, adequately maintain product integrity. For example, a paper carton likely will not prevent aroma, moisture, contaminants, small insects, etc., from passing through to the contained product. Thus, packaging for most particulate-type products requires an additional container or bag disposed within the paper carton. This is especially true for consumable/food products. A widely accepted technique for maintaining product integrity is to place the product into an inner container or bag that in turn is stored within the carton (commonly referred to as "bag in a box" technique). The bag is typically made of a plastic or glassine material and is sealed about the product. In this sealed form, the bag maintains product freshness and provides protection against contamination or insect infestation, whereas the outer paper carton provides packaging strength and display. Alternatively, a double packaging machine (DPM) technique may be employed to form a plastic or glassine liner within the paper carton. Regardless of the exact manufacturing process, the resulting packaging configuration includes a box with an inner liner. The box is a single layer paperboard or label stock material that provides structural integrity, whereas the separate inner liner serves as a barrier material.

The box with an inner liner packaging approach is universally employed. In fact, from a manufacturer's standpoint, box with an inner liner packaging satisfies a number of important criteria including low cost, stackability, and large, flat surfaces for displaying product and promotional information. Unfortunately, however, consumers may encounter several potential drawbacks with this packaging approach. For example, difficulties may be encountered when attempting to open the paper carton and/or the inner bag. To this end, one or both of the paper carton and plastic bag can be inadvertently torn. Once opened, the flexible nature of the inner bag makes it difficult to establish a consistent opening for uniform product flow. Finally, it is often times difficult to sufficiently re-close both the inner bag and the paper carton in a manner that prevents unexpected product displacement and/or contamination.

To overcome the above concerns, a canister configuration has been contemplated. For example, rigid plastic canisters having removable, sealable lids are available. The greatly increased cost associated with this packaging configuration prohibits its implementation on a mass production basis. Alternatively, baking flour has been commercially sold in a wax-coated paper carton to which an elongated plastic lid is attached. Unfortunately, packaging strength and barriers to contamination are limited, and the lid configuration does not promote uniform product flow upon removal. While not currently available, a more satisfactory approach may be the formation of a canister having wall(s) comprised of an inner plastic ply or layer bonded to one or more outer paper plies or layers. This novel technique may resolve several deficiencies associated with the traditional box with inner liner packaging, and presents opportunities for further manufacturing and performance enhancements. For example, the formed, combination paper and plastic nature of the canister may allow for a lid/closure structure that does not rely upon a folded paper tab or rolled bag utilized with paper cartons. In addition to solving opening and closing problems, the canister may have improved durability. Further, the canister and lid can be configured to promote simple, rapid assembly with mass production.

Consumers continue to express a high demand for particulate-type products, such as ready-to-eat cereal products, sold in paper cartons. However, various problems associated with standard packaging, and in particular box with an inner liner packages, may diminish purchasing enthusiasm. In fact, any efforts to satisfy consumer preferences on a cost effective basis while maintaining the beneficial properties of current packaging will likely result in heightened sales. In this regard, new canister packaging configurations may present distinct opportunities for lid enhancements. Therefore, a need exists for a paper and plastic container including an improved lid configuration.

SUMMARY OF THE INVENTION

One aspect of the present invention provides a canister for a particulate-type product. The canister includes a side wall, a bottom closure and a plastic lid. The side wall forms at least a portion of a tubular body defining an upper opening, a lower opening and an internal storage region for containing a particulate-type product. In this regard, the side wall includes a first, paper-based layer and a second, plastic-based layer. The first layer has an inner surface and an outer surface. The second layer is bonded to the inner surface of the first layer. The bottom closure encompasses the lower opening. Finally, the plastic lid is openably secured to the tubular body at the upper opening, and is configured to provide selective access to the internal storage region. With this configuration, the plastic lid facilitates ease of manufacture and enhances overall canister durability. Further, in one preferred embodiment, the plastic lid includes a flap pivotably secured to a body portion that in turn is attached to the side wall. During use, the flap is maneuvered to an opened position for providing access to the internal storage region.

Another aspect of the present invention relates to a packaged good article. The packaged good article includes a canister and a particulate-type product. The canister includes a side wall, a bottom closure and a plastic lid. The side wall forms at least a portion of a tubular body defining an upper opening, a lower opening and an internal storage region. With this in mind, the side wall includes a first, paper-based layer and a second, plastic-based layer. The first layer includes an inner surface and an outer surface. The second layer is bonded to the inner surface of the first layer. The bottom closure encompasses the lower opening. The plastic lid is openably secured to the tubular body at the upper opening. Finally, the particulate-product is contained within the internal storage region. In one preferred embodiment, the particulate-type product is a dried food product, such as a ready-to-eat cereal.

Yet another aspect of the present invention relates to a method of manufacturing a canister for containing a particulate-type product. The method includes providing a first, paper-based layer having an inner surface and an outer surface. A second, plastic-based layer is also provided. The second, plastic-based layer is bonded to the inner surface of the first, paper-based layer. The bonded first and second layers are formed into a tubular body having an upper opening and a lower opening. The lower opening is encompassed with a bottom closure. A plastic lid is provided. The plastic lid is openably secured to the tubular body at the upper opening. With this configuration, the tubular body defines an internal storage region for containing a particulate-type product. The use of a plastic lid facilitates manufacture of the canister and results in a canister with increased durability.

DESCRIPTION OF THE PREFERRED EMBODIMENTS

Figure 1:
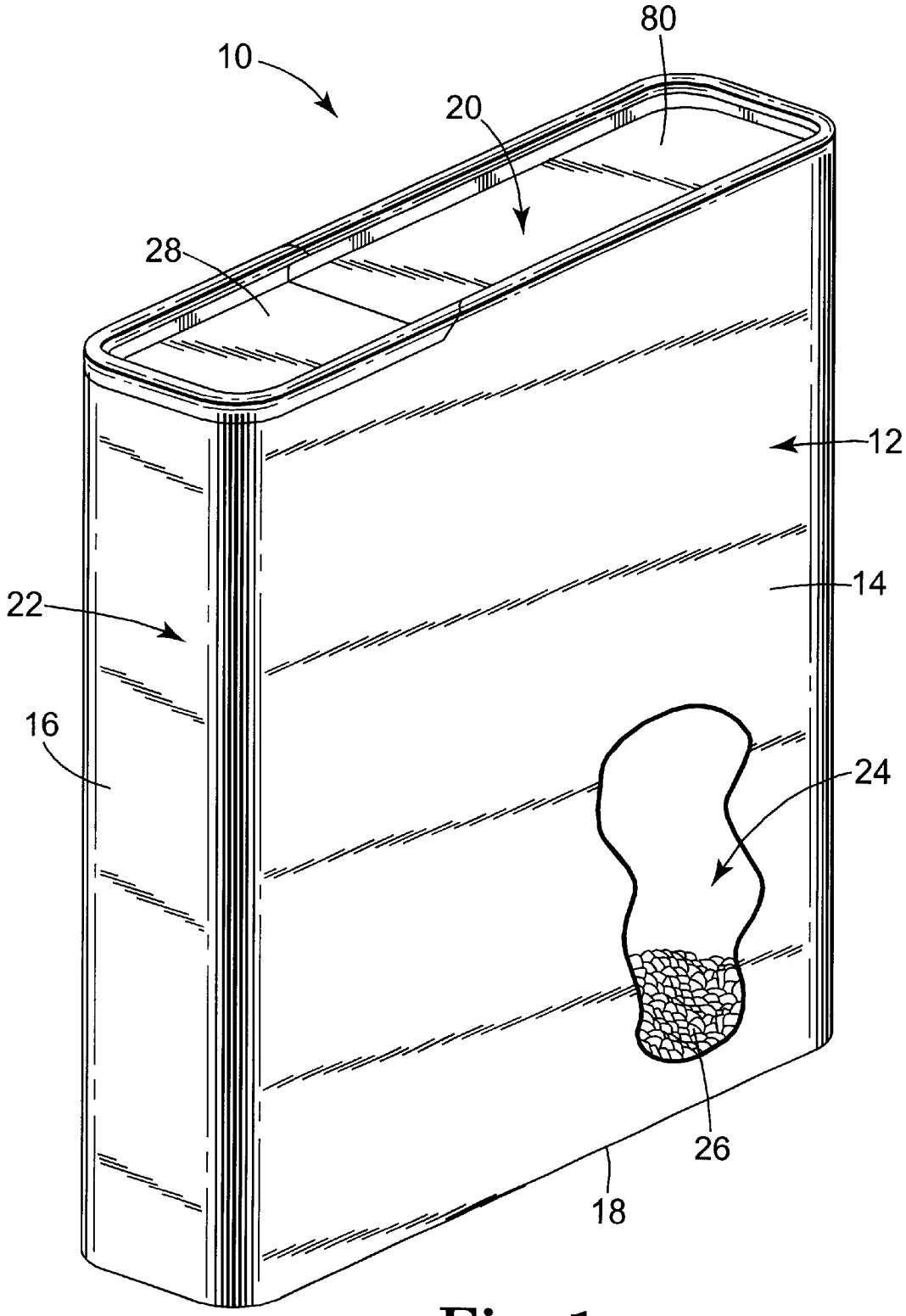
FIG. 1 is a perspective view of a canister in accordance with the present invention, with a portion cut away.

One preferred embodiment of a canister 10 is shown in FIG. 1. The canister 10 includes a side wall 12 preferably defining opposing face panels 14 (one of which is shown in FIG. 1) and opposing side panels 16 (one of which is shown in FIG. 1), a bottom panel or closure 18 (referenced generally in FIG. 1), and a lid 20. As used throughout this specification, directional terminology such as "bottom," "top," "upper," "lower," etc., is used for purposes of illustration and with reference to a desired upright orientation of the canister 10 as shown in FIG. 1. However, the canister 10 can be positioned in other orientations such that directional terminology is in no way limiting.

As described in greater detail below, the side wall 12 is preferably continuous, forming at least a portion of, preferably an entirety of, a tubular body 22 that defines the opposing face panels 14 and the opposing side panels 16. Thus, the term "side wall" as used throughout the specification is in reference to one or more of the opposing face panels 14 and/or the opposing side panels 16. It should be understood, however, that the opposing face panels 14 and the opposing side panels 16 can be separately formed and assembled. Even further, the side wall 12, and thus the tubular body 22, need not necessarily assume the generally rectangular configuration shown in FIG. 1. For example, the canister 10 can be circular in cross-section, such that the side wall 12, and thus the tubular body 22, is formed to be cylindrical, frusto-conical, etc. With these alternative shapes, distinct or distinguishable face and side panels will not be formed.

The bottom panel 18 is connected to the tubular body 22 at a lower portion thereof. Similarly, the lid 20 is connected to the tubular body 22 at an upper portion thereof This configuration provides an internal storage region 24 (shown partially in FIG. 1) within which a particulate-type product 26 is disposed. In one preferred embodiment, and as described in greater detail below, the particulate-type product 26 can be dispensed from the internal storage region 24 by opening a hinged flap 28 formed by the lid 20. Alternatively, the lid 20 can be entirely removable from the tubular body 22.

Figure 2:
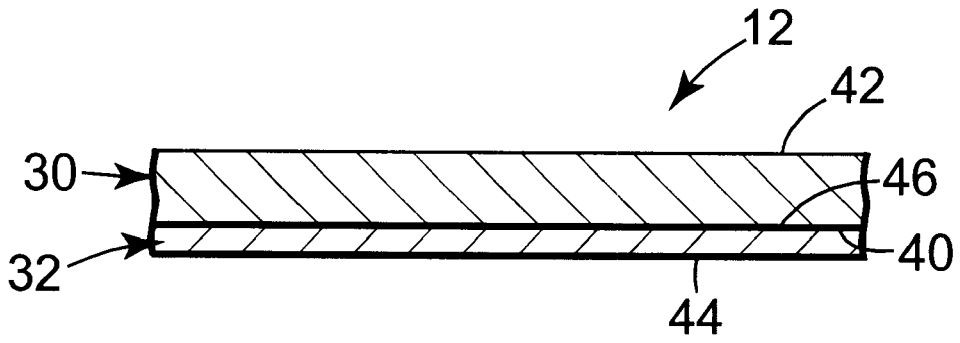
FIG. 2 is a cross-sectional view of a portion of the canister of FIG. 1.

The side wall 12 is comprised of at least two layers, as shown in FIG. 2. As a point of reference, the cross-sectional view of FIG. 2 depicts a portion of the side wall 12, such as a portion one of the opposing face panels 14 (FIG. 1) and/or the opposing side panels 16 (FIG. 1). In a preferred embodiment, the side wall 12 is continuous in forming the tubular body 22 (FIG. 1), such that each of the opposing face panels 14 and the opposing side panels 16 are similarly constructed. Alternatively, as few as one of the opposing face panels 14 or the opposing side panels 16 need have the construction illustrated in FIG. 2. With the above in mind, the side wall 12 includes a first, paper-based layer 30 and a second, plastic-based layer 32.

The first, paper-based layer 30 defines an inner surface 40 and an outer surface 42, and is preferably a label stock paper material being 14-point or less in thickness. Label stock material is readily available and is highly amenable to printing on the outer surface 42. Printing onto label stock paper material is well-known in the art and may include product information, promotional statements, etc. To minimize overall costs, the label stock paper material is preferably formed from recycled paper. Alternatively, the first, paper-based layer 30 can have other thicknesses and can be paperboard.

The second, plastic-based layer 32 defines an inner surface 44 and an outer surface 46, and provides a functional or contamination barrier to at least one of flavor, aroma, moisture, oil, grease, other contaminants, insects, etc. As a point of reference, the inner surface 44 is the inner surface of the canister 10 (FIG. 1). The selected plastic for the second layer 32 must be suitable for contact with the particulate-type product 26 (FIG. 1). For example, where the particulate-type product 26 is a food product, the selected plastic material must be approved for food contact, as is well-known in the art. Thus, for example, the plastic material can be polyethylene (low density or high density), chlorinated plastic, ethylene vinyl acetate, polyester, nylon, polypropylene, etc. Even further, the plastic material can be various co-polymers, blends, or a combination of plastic materials. In one preferred embodiment, the second layer 32 is a combination of at least two plastic materials, with one plastic material serving as a barrier portion and the other as a sealant portion. Basically, the sealant portion has a lower melt point than the barrier portion such that upon application of heat and pressure, the sealant portion melts and laminates to the inner surface 40 of the first, paper-based layer 30. For example, the second layer 32 can include a polyethylene barrier portion and an ethylene vinyl acetate resin forming the sealant portion. Alternatively, other lamination or bonding techniques can be employed, such as use of an adhesive.

Figure 3:
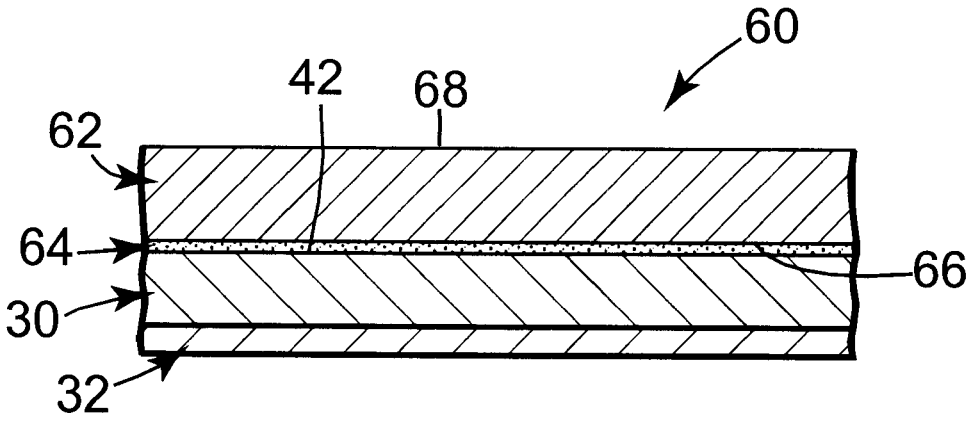
FIG. 3 is a cross-sectional view of a portion of an alternative embodiment canister in accordance with the present invention.

While the side wall 12 has been described as been described with reference to two layers 30, 32, additional layer can be provided. For example, FIG. 3 provides a cross-sectional view of a more preferred alternative side wall 60. The side wall 60 includes the first, paper-based layer 30, and the second, plastic-based layer 32. In addition, the side wall 60 includes a third layer 62 and an adhesive 64. The third layer 62 is preferably paper-based and defines an inner surface 66 and an outer surface 68. The inner surface 66 is bonded to the outer surface 42 of the first, paper-based layer 30 by the adhesive 64.

With the side wall 60, the first-paper based layer 30 is a paper board or liner board material, such as 42-pound liner board, and is laminated to the second, plastic-based layer 32 as previously described.

The third layer 62 is also a paper-based material, but is preferably label stock being 14-point or less in thickness. As previously described, label stock material is readily available and is highly amenable to printing on the outer surface 68. By providing two different thicknesses for the first layer 30 and the third layer 62, overall costs of the resulting side wall 60 are minimized. In other words, use of a single, thick layer of non-recycled paper inherently increases costs. It should be noted, however, that the first layer 30 and the third layer 62 can alternatively be identical in thickness and composition.

The adhesive 64 is preferably a cold adhesive. For example, the adhesive 64 can be polyvinyl alcohol, polyvinyl acetate, casein, starch, etc. Even further, the cold adhesive can be various blends or combinations of acceptable cold adhesive materials and/or other materials such as activators. Alternatively, the adhesive 64 can be a hot-melt adhesive, such as a polyethylene-based material with tackifiers and wax, a polypropylene-based material with tackifiers and wax, a polyester-based material with tackifiers and wax, etc. Even further, the hot-melt adhesive can be various co-polymers, blends, or a combination of acceptable adhesive materials and/or other materials such as activators. Notably, cold adhesives are generally less expensive than hot-melt adhesives and typically require a reduced volume to achieve an appropriate bond. Further, cold adhesives generally do not produce an adverse, "adhesive-like" odor that might otherwise adversely affect quality of the particulate-type product 26 (FIG. 1) contained within the canister (FIG. 1). The adhesive 64 can be applied in a wide variety of fashions, including flood coating or pattern application.

Figure 4:
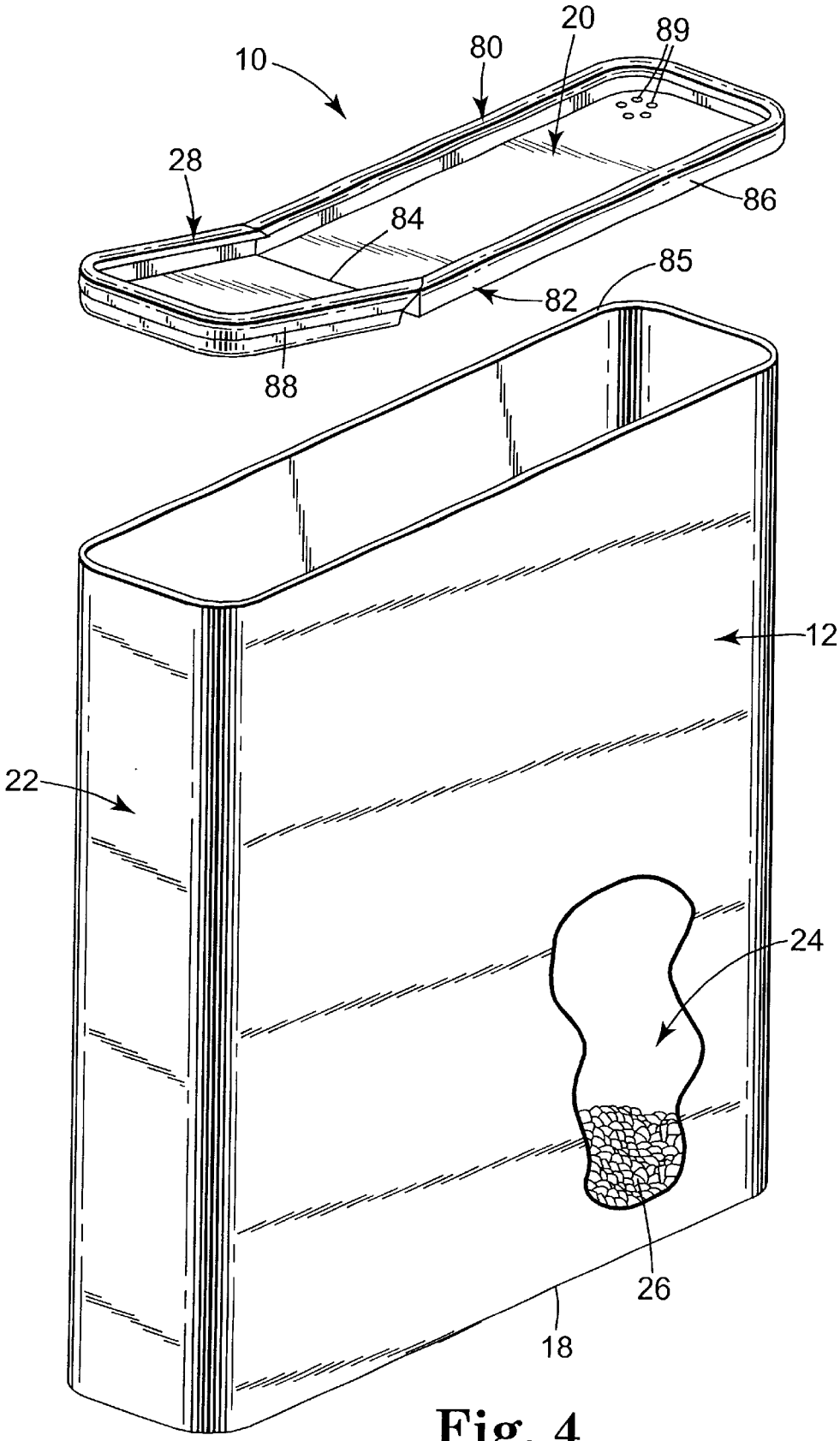
FIG. 4 is an exploded, perspective view of a portion of the canister of FIG. 1, including a lid.

The lid 20 is depicted in greater detail in FIG. 4. The lid 20 includes a body portion 80, the flap 28 and a skirt 82. The flap 28 is pivotably secured to the body portion 80 along a hinge line 84 such that the flap 28 is moveable relative to the body portion 80 from a closed position (FIG. 1) to an open position (FIG. 4). The skirt 82 extends downwardly from, and defines a perimeter of, the body portion 80 and the flap 28.

The lid 20 is configured to be secured to the tubular body 22, and is therefore sized and shaped in accordance with a size and shape of the tubular body 22. For example, the lid 20 can assume the elongated, generally rectangular shape of FIG. 4. To facilitate assembly with the tubular body 22, the skirt 82 is preferably sized to be frictionally received within the tubular body 22. Alternatively, the skirt 82 can form a lip configured to extend over and frictionally engage a leading edge 85 of the tubular body 22. Preferably, however, construction of the skirt 82 is such that snap-fit is achieved between at least a portion of the lid 20 and the tubular body 22. To this end, a first section 86 of the skirt 82 (associated with the body portion 80) can be sized to achieve a more permanent attachment to the leading edge 85 of the tubular body 22, whereas a second section 88 (associated with the flap 28) is more easily detachable therefrom. Even further, an additional structure may be provided to more permanently secure the body portion 80, such as an adhesive, tape, etc.

As previously described the flap 28 is movable relative to the body portion 80 along the hinge line 84 to provide selective access to the internal storage region 24 upon final assembly. This feature can be achieved with a number of other configurations for the lid 20. For example, the lid 20 can be a uniform, relatively rigid body that is entirely securable to, and removable from, the tubular body 22. Alternatively, the flap 28 can be separate from the body portion 80 such that the flap 28 is completely detached from both the tubular body 22 and the body portion 80 during use. Even further, the flap 28 can form a spout or other structure designed to promote product flow.

Regardless of exact form, the lid 20, including the body portion 80, the flap 28 and the skirt 82, is preferably integrally formed from a rigid, plastic material. The plastic material selected for the lid 20 must be approved for use with the particulate-type product 26 and is preferably compatible with the material selected for the second, plastic-based layer 32 (FIG. 2). For example, where the particulate-type product 26 is a food product, the plastic material selected for the lid 20 can be polyethylene (low or high density), chlorinated plastic, ethylene vinyl acetate, polyester, nylon, polypropylene, polycarbonate, polyvinyl chloride, etc. Other acceptable materials include polystyrene, ethylene vinyl alcohol, etc. Even further, the plastic material can be various co-polymers, blends, or a combination of plastic materials.

By forming the lid 20 from a plastic material, as well as the side wall 12 and the bottom panel 18 to include a plastic-based layer (such as the second, plastic-based layer 32 of FIG. 2), a relatively sealed environment can be established for the canister 10. To minimize the potentially adverse effects of atmospheric pressure changes experienced by the canister 10, in one preferred embodiment, the lid 20 forms a plurality of minute air vent holes 89 (greatly exaggerated in FIG. 4 for purposes of illustration). While extremely small in diameter (on the order of 10–100 micrometers), the air holes 89 allow airflow into and out of the internal storage region 24 that is otherwise essentially hermetically sealed. Thus, the air holes 89 provide for venting of air from the internal storage region 24 upon a decrease in atmospheric or barometric pressure acting upon an exterior of the canister 10, thereby preventing potentially damaging swelling of the canister 10.

Figure 5:
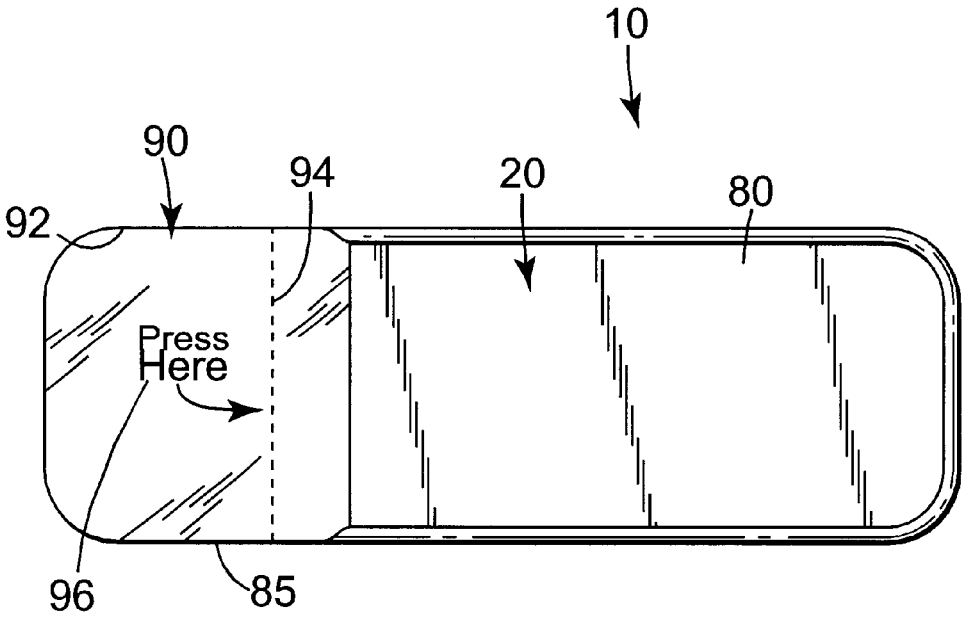
FIG. 5 is a top view of an alternative embodiment canister in accordance with the present invention.

In one preferred embodiment, to enhance a perception of product freshness and to provide an indication of product tampering, the canister 10 can further include a membrane 90 as shown in FIG. 5. For ease of illustration, the canister 10 is depicted in FIG. 5 with the flap 28 (FIG. 4) removed. The membrane 90 is preferably positioned beneath the lid 20, and in particular the flap 28, and extends across an upper opening 92 in the tubular body 22 along the leading edge 85. The membrane 90 is preferably a thin layer comprised of plastic, paper or a combination thereof. To facilitate removal of at least a portion of the membrane 90, the membrane 90 is preferably formed to include perforations 94. The perforations 94 can be imparted via any known manufacturing technique and can assume a wide variety of forms. Additionally, the membrane 90 can include indicia 96 configured to provide visual instructions to a user proper membrane removal, such as words, symbols or illustrations. Regardless, the membrane 90 is either partially or completely removed to expose the upper opening 92.

Figure 6:
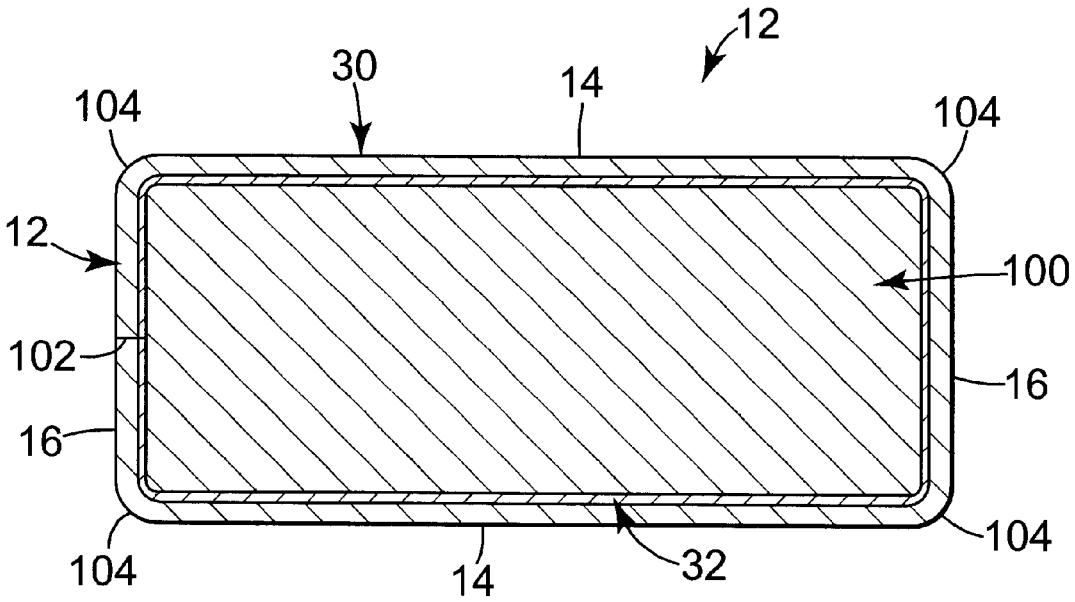
FIG. 6 is a side, cross-sectional view depicting assembly of a portion of the canister of FIG. 1.

Assembly of the canister 10 begins with formation of the side wall 12, such as by laminating the second, plastic-based layer 32 (FIG. 2) to the first, paper-based layer 30 (FIG. 2). Once formed, the side wall 12 is cut to an appropriate size. The opposing face panels 14 and the opposing side panels 16 are then formed from, for example as illustrated in FIG. 6. In one preferred embodiment, the side wall 12 is wrapped about a mandrel 100. Opposing edges of the side wall 12 are connected to form a seal 102. The seal 102 can be a butt seal as shown, but alternatively can be an overlapped seal, fin seal, etc. Notably, the layers 30, 32 can alternatively be staggered or rotated 180 degrees from one another. As shown in FIG. 6, in the sealed configuration, the side wall 12 defines and integrally forms the opposing face panels 14 and the opposing side panels 16. Notably, with the mandrel fabrication technique, corners 104 formed by the opposing face panels 14 and the opposing side panels 16 are preferably rounded or arcuate, but instead can be angular. Alternatively, the opposing face panels 14 and the opposing side panels 16 can be independently formed and subsequently connected, preferably sealed, to one another. Even further, as previously described, the mandrel 100 can be circular in cross-section such that only a single, continuous panel is formed. Regardless, following formation of the seal, the side wall 12 forms the tubular body 22.

Figure 7:
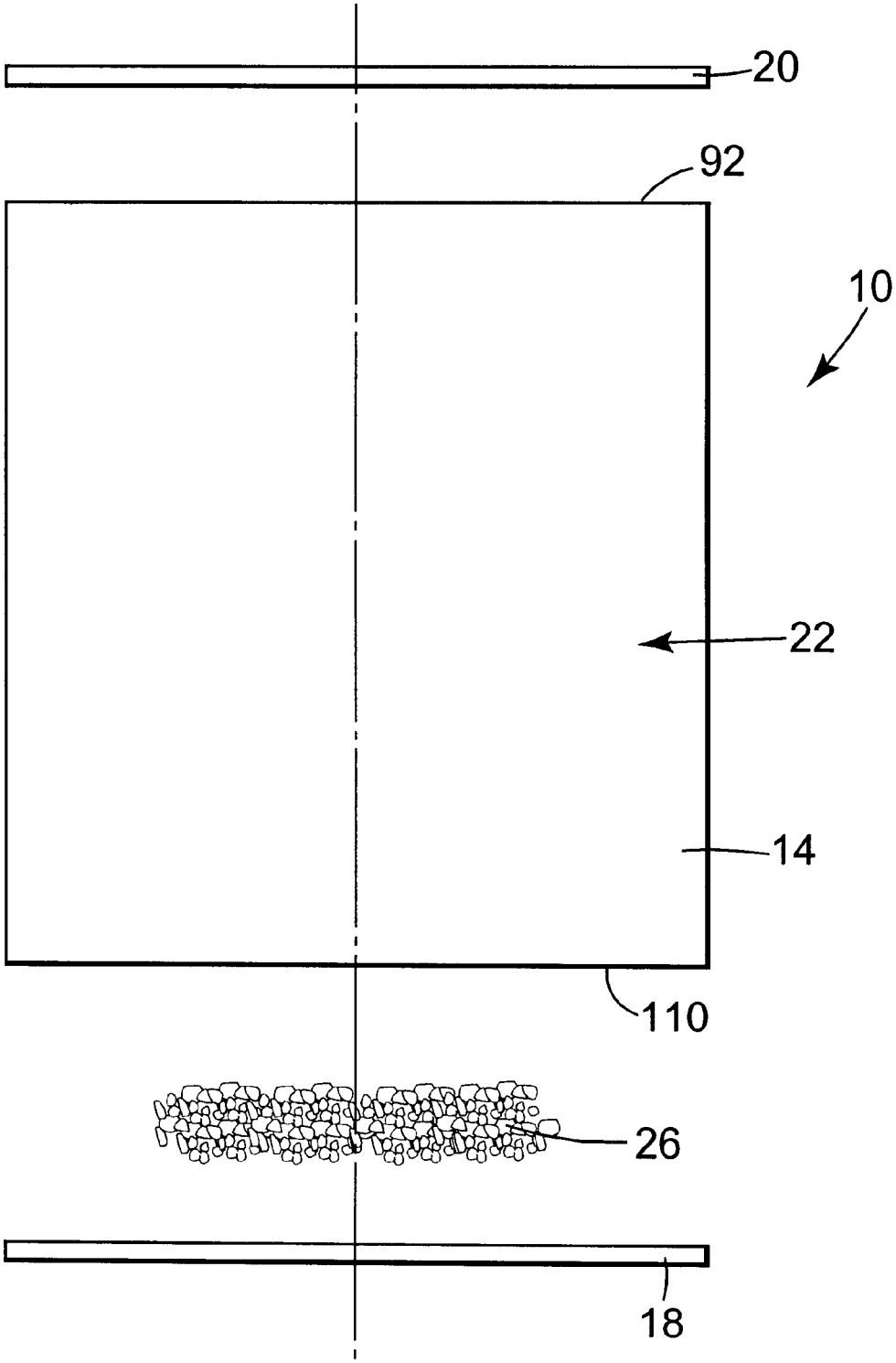
FIG. 7 is an exploded, plain view of a canister of FIG. 1.

A remainder of the canister 10 is then constructed as shown in FIG. 7. Once formed, the tubular body 22 includes the upper opening 92 (referenced generally in FIG. 7) and a lower opening 110 (referenced generally in FIG. 7). The lid 20 is then connected to the tubular body 22 so as to encompass the upper opening 92. Notably, by forming the lid 20 from a plastic material, assembly to the tubular body 22 can be performed in a rapid fashion unlike prior paper-based lids/packages. As previously described, at least a portion of the lid 20 is selectively secured to the tubular body 22 (such as the flap 28). The particulate-type product 26 is then placed within the internal storage region 24 (FIG. 1) defined by the tubular body 22. Finally, the bottom closure 18 is connected to the tubular body 22 so as to encompass the lower opening 110. The bottom closure 18 is preferably a panel that includes laminated paper and plastic layers as previously described with reference to the side wall 12. Alternatively, the lower opening 110 can simply be sealed closed. While construction of the canister 10 has been described as preferably including placement of the lid 20 and then the bottom closure 18, this order can be reversed. Further, other enhancement features, such as a tamper evident tape/seal secured across at least a portion of the seam between the lid 20 and the tubular body 22, can be incorporated.

By preferably forming the side wall 12 and the bottom closure 18 from the first paper-based layer 30 (FIG. 2) and the second, plastic-based layer 32 (FIG. 2), and the lid 20 from a plastic material, the canister 10 is sealable and provides a functional barrier to at least one of flavor, aroma, moisture, oil, grease, insects, or other contaminates. Thus, the canister 10 can be used to maintain a wide variety of particulate-type products. For example, the particulate-type product 26 can be a food product, and in particular, a dried food product. One specific category of available food products is cereal-based products (e.g., formed from wheat, oats, rice, etc.). These include ready-to-eat cereals, such as puffs, flakes, shreds, and combinations thereof. Further, the ready-to-eat cereal product can include other ingredients, such as dried fruits, nuts, dried marshmallows, sugar coatings, etc. Alternatively, other particulate-type dried food products can be maintained by the canister 10, such as, for example, popcorn (popped or un-popped), dried pasta (e.g., spaghetti noodles), rice, beans, pretzels, potato chips, sugar, dried milk, flour, etc. Even further, other consumable items, such as birdseed, can constitute the particulate-type product 26. Yet even further, non-consumable particulate-type products, including fertilizer pellets, dry laundry detergent, dry dishwashing detergent, plants or vegetable seeds, de-icing salt pellets, etc., can be stored within the canister 10. Regardless of the exact product constituting the particulate-type product 26, the combination paper and plastic side wall 12 in conjunction with the plastic lid 20 allows the canister 10 to maintain the integrity of the particulate-type product 26 independent of any additional liners or bags.

Figure 8:
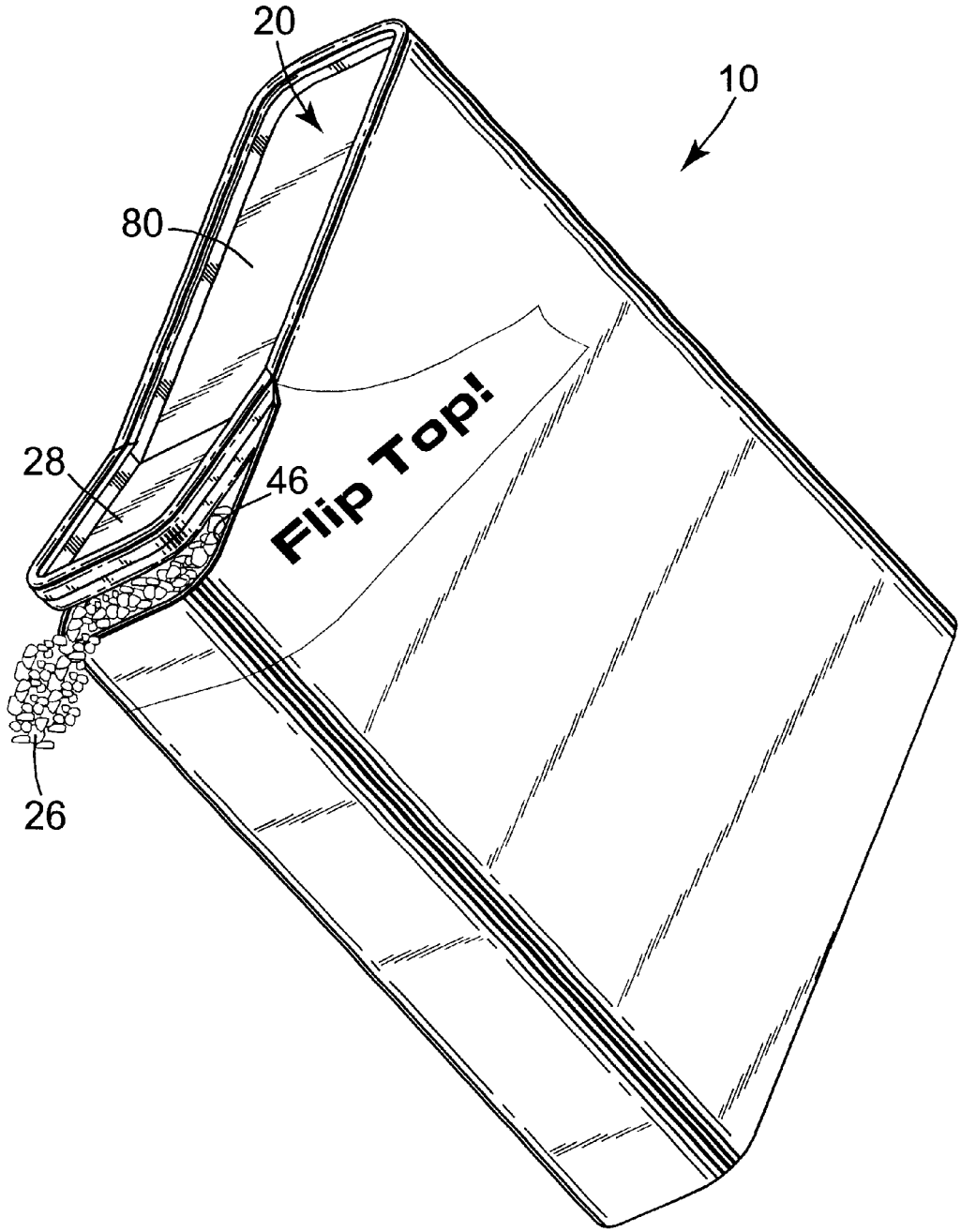
FIG. 8 is a perspective view of the canister of FIG. 1 in an opened configuration.

Upon final assembly, the canister 10 is available for shipment and commercial sale. In this regard, the relatively rigid nature of the lid 20 enhances the overall durability of the canister 10. That is to say, unlike currently available paper cartons, the plastic lid 20 reinforces the canister 10 against transverse and/or lateral forces commonly encountered during shipping. Following purchase, a consumer (not shown) gains access to the particulate-type product 26 by opening the lid 20 as shown in FIG. 8. As previously described, at least a portion of the lid 20, such as the flap 28, is openable relative to the tubular body 22, thereby providing a pour opening 112 through which the particulate-type product 26 can be dispensed from the canister 10. For example, the flap 28 can be pivoted relative to the body portion 80. With this one preferred embodiment, by forming the lid 20 from a plastic material, a relatively rigid frictional engagement of the flap 28 relative to the body portion 80 in the open position can be established, thereby enhancing product dispensement and consumer satisfaction.

Following dispensement of a desired volume of product, the canister 10 can effectively be "re-sealed" by closing the lid 20. With reference to the one preferred embodiment, the flap 28 is maneuvered from the open position shown in FIG. 8 to the closed position of FIG. 1. In this regard, by forming the lid 20 from a plastic material, it is possible to provide for an audible snap-fit during the closure operation, thereby providing the consumer with an indication of proper closure. Once resealed, the canister 10 again provides a functional barrier for the particulate-type product 26 to air, moisture, contaminants, etc.

The canister of the present invention provides a marked improvement over previous designs. In particular, by forming the main body portion of the canister from a combination of paper and plastic materials, as well as providing a plastic lid, a durable, relatively sealed package is formed. In addition, the plastic lid is easily assembled to the canister body, can more readily maintain an open position, and can provide an audible indication of proper closure.

Although the present invention has been described with reference to preferred embodiments, workers skilled in the art will recognize that changes can be made in form and detail without departing from the spirit and scope of the present invention. For example, the canister has been depicted as being generally rectangular in shape. Alternatively, other shapes are equally acceptable. Also, the canister can contain items in addition to the particulate-type product. For example, a separate coupon or premium can be placed within the canister along with the particulate-type product.

What is claimed is:

1. A canister for containing a particulate-type product, the canister comprising:

a side wall forming at least a portion of tubular body defining an upper opening, a lower opening and an internal storage region for containing a particulate-type product, the side wall including:

a first, paper-based layer having an inner surface and an outer surface, a second, plastic-based layer bonded to the inner surface of the first layer;

a bottom closure encompassing the lower opening; and a plastic lid openably secured to the tubular body at the upper opening, the plastic lid providing selective access to the internal storage region and characterized by the absence of a paper-based layer;

wherein the tubular body defines a transverse perimeter at the upper opening, and further wherein the lid is configured such that upon final assembly, a periphery of the lid does not project laterally outside of the transverse perimeter.

2. The canister of claim 1, further comprising:

a third, paper-based layer bonded to the outer surface of the first layer.

3. The canister of claim 2, further comprising an adhesive bonding the first and third layers.

4. The canister of claim 2, wherein the first layer is a label stock material and the third layer is a liner board material.

5. The canister of claim 1, wherein the second, plastic-based layer is laminated to the first, paper-based layer.

6. The canister of claim 1, wherein the lid includes a body portion and a flap pivotably secured to the body portion.

7. The canister of claim 1, wherein the plastic lid is configured to provide a snap-fit with the tubular body.

8. The canister of claim 1, wherein the plastic lid and the side wall are configured to be sealable to one another.

9. The canister of claim 1, wherein the tubular body defines opposing face panels and opposing side panels.

10. The canister of claim 1, wherein the plastic lid forms a plurality of air holes.

11. The canister of claim 1, wherein the tubular body is configured to contain a ready-to-eat cereal.

12. The canister of claim 1, wherein the lid includes a skirt adapted to nest within the tubular body, the canister further comprising:

a membrane sealed to the tubular body below the skirt.

13. The canister of claim 1, wherein the lid is configured such that upon final assembly, the canister defines a contiguous, transverse outer periphery at an upper end thereof.

14. A packaged good article comprising:

a canister comprising:

a side wall forming at least a portion of a tubular body defining an upper opening, a lower opening and an internal storage region having a transverse perimeter, the side wall including:

a first, paper-based layer having an inner surface and an outer surface, a second, plastic-based layer bonded to the inner surface of the first layer, a bottom closure encompassing the lower opening, a plastic lid openably secured to the tubular body at the upper opening, the plastic lid providing selective access to the internal storage region and characterized by the absence of a paper-based layer, the plastic lid including a skirt; and a particulate-type product contained within the internal storage region;

wherein the lid is configured such that upon final assembly, the skirt nests within the tubular body and a periphery of the lid does not project laterally outside of the transverse perimeter.

15. The packaged good article of claim 14, further comprising:

a third, paper-based layer bonded to the outer surface of the first layer.

16. The packaged good article of claim 15, further comprising an adhesive bonding the first and third layers.

17. The packaged good article of claim 15, wherein the first layer is a label stock material and the third layer is a liner board material.

18. The packaged good article of claim 14, wherein the second, plastic-based layer is laminated to the first, paper-based layer.

19. The packaged good article of claim 14, wherein the lid includes a body portion and a flap pivotably secured to the body portion.

20. The packaged good article of claim 14, wherein the plastic lid is configured to provide a snap-fit with the tubular body.

21. The packaged good article of claim 14, wherein the plastic lid and the side wall are configured to be sealable to one another.

22. The packaged good article of claim 14, wherein the tubular body defines opposing face panels and opposing side panels.

23. The packaged good article of claim 14, wherein the plastic lid forms a plurality of air holes.

24. The packaged good article of claim 14, wherein the particulate-type product includes a dried food product.

25. The packaged good article of claim 24, wherein the dried food product includes a ready-to-eat cereal.

26. The packaged good article of claim 14, further comprising:

a membrane sealed to the tubular body below the skirt.

27. A canister for containing a particulate-type product, the canister comprising:

a side wall forming at least a portion of a tubular body defining an upper opening, a lower opening and an internal storage region for containing a particulate-type product, the side wall including:

a first, paper-based layer having an inner surface and a lower surface, a second, plastic-based layer bonded to the inner surface of the first layer, wherein the tubular body defines a transverse perimeter shape at the upper opening including opposing pairs of linear edges and four rounded corners;

a bottom closure encompassing the lower opening; and a plastic lid openably secured to the tubular body, at the upper opening, the plastic lid providing selective access to the internal storage region, wherein the lid is characterized by the absence of a paper-based layer and is configured such that upon final assembly, a periphery of the lid does not project laterally outside of the transverse perimeter shape.

28. The canister of claim 27, wherein the lid includes a skirt configured to nest within the tubular body.

29. The canister of claim 28, further comprising:

a membrane sealed to the tubular body below the skirt.

* * * * *